US006457796B1

(12) United States Patent
Fujii

(10) Patent No.: US 6,457,796 B1
(45) **Date of Patent: *Oct. 1, 2002**

(54) INK JET RECORDING HEAD AND PRINTING SYSTEM USING SAME

(75) Inventor: Masahiko Fujii, Ebina (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/576,320

(22) Filed: May 22, 2000

(30) Foreign Application Priority Data

Jun. 23, 1999 (JP) ..... 11-176415

(51) Int. Cl.[7] ..... B41J 29/38
(52) U.S. Cl. ..... 347/12; 347/62; 347/40
(58) Field of Search ..... 347/12, 13, 15, 347/40, 42, 43, 62, 65, 48

(56) References Cited

U.S. PATENT DOCUMENTS 5,208,605 A * 5/1993 Drake ..... 347/40
5,412,410 A * 5/1995 Rezanka ..... 347/40
5,988,798 A * 11/1999 Hirasawa et al. ..... 347/62
6,062,678 A * 5/2000 Ishinaga et al. ..... 347/62

FOREIGN PATENT DOCUMENTS

JP 8-332727 12/1996

* cited by examiner

*Primary Examiner*—Lamson Nguyen
(74) *Attorney, Agent, or Firm*—Morgan, Lewis & Bockius LLP

(57) ABSTRACT

The present invention provides an ink jet recording head in which an ink droplet having a small volume that can realize a desired image quality can be ejected onto a recording sheet without making a space between dots in normal printing, and further, in which an ink droplet having a large volume that can afford a sufficient density can be ejected even when thinning-out printing is performed in high-speed printing. An ink jet recording head having two ink supplying openings that introduce ink from an ink tank, an ink chamber that temporarily contains ink introduced from the ink supplying openings and a set of two kinds of first and second ink flowing paths mounted alternately on a flowing path substrate. The first ink flowing path ejects an ink droplet of 7 pl and its ejecting amount is constant. The second ink flowing path selectively ejects one of ink droplets of two volumes, i.e., ink droplets of 7 pl and ink droplets of 30 pl. Specifically, the volume of ink droplets ejected from the second ink flowing path is variable. In the normal printing mode, ink droplets of 7 pl are ejected from the first and second ink flowing paths, while ink droplets of 30 pl are ejected from only the second ink flowing path in the high-speed printing mode.

10 Claims, 8 Drawing Sheets

NORMAL PRINTING MODE

HIGH-SPEED PRINTING MODE

RELATED ART

RELATED ART

INK JET RECORDING HEAD AND PRINTING SYSTEM USING SAME

BACKGROUND OF THE INVENTION

1. Field of the Invention

The present invention relates to an ink jet recording head, and more particularly to an ink jet recording head of a thermal ink jet type.

2. Description of the Prior Arts

There has been known an ink jet recording head of a thermal ink jet type as an ink jet recording apparatus wherein an ink droplet is ejected onto a recording sheet according to an image signal for recording an image, a character and the like.

The ink jet recording apparatus of such a thermal ink jet type has, for example, an ink jet recording head; 70 having a construction shown in FIG. 7. This ink jet recording head 70 is provided with a heating substrate 52 and a flowing path substrate 50 formed on the heating substrate 52. The heating substrate 52 has electricity/heat converting elements 60, each of which is arranged at a position corresponding to each ink flowing path 58 described later and has the same size. An electric pulse is applied to the electricity/heat converting element 60 via a device not shown or wiring according to an image signal.

Provided at the flowing path substrate 50 are an ink supplying opening 56 that introduces ink from an ink tank not shown, an ink chamber 54 for temporarily keeping ink introduced from the ink supplying opening 56 and plural ink flowing paths 58, which is ends on one side are open to the ink chamber 54 and ends on the other side form an ejecting opening 59.

The ink chamber 54 and the ink flowing path 58 are filled with ink upon recording an image. When the electric pulse is applied to the electricity/heat converting element, i.e. thermal element, 60 from the heating substrate 52 according to the image signal, the electricity/heat converting element 60 generates heat to form a bubble at the heating portion. This bubble brings a pressure to ink in the ink flowing path to eject ink from the ejecting opening 59, whereby the ejected ink is adhered onto a recording sheet arranged so as to oppose to the ejecting opening 59, thereby recording an image.

Generally, a high resolution of 600 dpi or more or an ejection of an extremely minute ink droplet of 10 pl or less are required for recording an image of a high quality. In the case of recording an image of a high quality by using the ink jet recording head of a thermal ink jet type having the above-mentioned construction, a period for one scan increases since an area where an ink droplet is adhered by one ejection is small. Further, a relative moving speed of the head in the slow-scanning direction becomes slow, resulting in considerable slowdown of the printing speed.

Moreover, the smaller the size of the ejected ink droplet is made for obtaining an image of higher quality, the less the ink amount adhered onto the recording sheet for one scan becomes, whereby the density of the image becomes low. Therefore, it is required that a slow-scan is repeated in plural times for ejecting ink droplets in plural times at the same position on a recording sheet to adjust the density to a desired one (multi-scan). This brings a slower printing speed.

Accordingly, printing is conventionally performed by changing a dot number between normal printing and high-speed printing. As one of such methods, a method has been known wherein an image is formed by all dots as shown in FIG. 8A in normal printing while an image is formed in high-speed printing by dots fewer than the dots in number in normal printing as shown in FIG. 8B, i.e., an image is formed by thinning-out printing, thereby enhancing a relative printing speed in the fast-scanning direction and slow-scanning direction to perform high-speed printing.

Japanese Published Unexamined Patent Application No. Hei 8-332727 discloses an ink jet recording head having large and small heaters 62 and 64 arranged laterally in an ink flowing path 58 as shown in FIG. 9A, or arranged longitudinally in the ink flowing path 58 as shown in FIG. 9B, wherein the small heater 62 is turned on in the normal printing to eject small ink droplets, while only the large heater 64 or both of the small and large heaters 62 and 64 are turned on in high-speed printing to eject large ink droplets.

Generally, ejectable ink droplets having a smaller size is preferable for recording an image with high resolution, while ejectable ink droplets having a larger size is preferable for performing thinning-out printing to print at a high speed. Therefore, it is required to have a construction such that the size of ink droplets which can be ejected from a single ink jet recording head can be greatly switched over.

For example, a volume of an ink droplet required for forming dots on a sheet with a resolution of 800 dpi without a space is approximately 7 pl to 15 pl per one droplet. In order to obtain an image with higher resolution than 800 dpi for rendering graininess unnoticeable, ink droplet having smaller volume is required. On the other hand, in the case where dots are thinned out every other one dot for high-speed printing, a volume of an ink droplet required for filling the space between each dot with a resolution of 400 dpi is approximately 20 to 50 pl per droplet.

Specifically, it is desired that a ratio of a dot diameter of the minimum ink droplet that can be ejected from a single ink jet recording head and a dot diameter of the maximum ink droplet has a wide range of at least approximately 1:3 to 1:7.

However, it is difficult to greatly change the size of an ink droplet in the ink jet recording head having the conventional construction.

For example, in the case where two heaters 62 and 64 are arranged laterally in the ink flowing path 58 as shown in FIG. 9A, the volume of an ejectable ink droplet is limited by the size of the heater (i.e., amount of generated heat) and the width of the flowing path.

Specifically, if the width of the flowing path is enlarged, the size of the heater that can be arranged can be made large, so that an ink droplet having greater volume can be ejected to increase the dot diameter that can be formed. However, since the resolution at the ejecting opening becomes low, that brings a wide space between each dot formed by ejecting ink droplets of a small volume, thereby unpreferable. Accordingly, the limit is the volume ratio of approximately 1:2 of a volume of the minimum ink droplet that can be ejected from the ink jet recording head and a volume of the maximum ink droplet in the case of laterally arranging the heating element.

Further, in the case where two heaters 62 and 64 are longitudinally arranged in the ink flowing path 58 shown in FIG. 9B, the size of the heating element can be enlarged without widening the width of the flowing path compared to the case where the heating element is laterally arranged. However, a signal electrode for selecting two heating elements and an electrode for applying a voltage need to be wired for every flowing path. Since the width of the flowing path for such electrodes are required, a heating element having a sufficient size cannot be arranged. Therefore, the limit is the volume ratio of approximately 1:2.5 of a volume of the minimum ink droplet that can be ejected from the ink jet recording head and a volume of the maximum ink droplet.

If the width of the flowing path is enlarged for ejecting ink droplets having a larger volume, a low resolution at the ejecting opening is inevitable. Although a slight improvement is made compared to the case where the heating element is laterally arranged, it is impossible to greatly increase the ratio of the dot diameter of the minimum ink droplet to the dot diameter of the maximum ink droplet.

Moreover, the length of the flowing path becomes long in the longitudinal arrangement compared to the lateral arrangement, thereby enlarging a fluid resistance from the ink chamber to the orifice. Therefore, this longitudinal arrangement has a problem that the resupply of the ink jet becomes slow after ejecting ink droplets, whereby high-speed printing cannot be performed.

Specifically, the conventional ink jet recording head has a disadvantage that, when the resolution in the normal printing is increased so as priorly to obtain an image of high quality, a large dot cannot be formed in high-speed printing, thereby making a space between each dot formed onto a recording sheet. Therefore, an image has a lower density than the desired density. Conversely, the resolution in normal printing is decreased when high-speed printing takes priority, thereby degrading image quality.

SUMMARY OF THE INVENTION

The present invention has been made in view of the above circumstances and provides an ink jet recording head in which an ink droplet having a small volume that can realize a desired image quality can be ejected onto a recording sheet without making a space between dot's in the normal printing, and further, in which an ink droplet having a large volume that can afford a sufficient density can be ejected even when a thinning-out printing is performed in high-speed printing.

The present invention provides a construction such that an ink jet recording head has a first ink flowing path that ejects ink supplied from one side thereof from an ejecting opening at the other side thereof as an ink droplet of a constant amount and a second ink flowing path that can eject ink supplied from one side thereof from an ejecting opening at the other side thereof as an ink droplet of an amount more than the constant amount as well as that can adjust the amount of the ink droplet to be ejected, wherein sets of ink flowing paths including the first ink flowing path and the second ink flowing path are alternately arranged.

Set of ink flowing paths having the first ink flowing path, the ejecting amount of which is constant, and the second ink flowing path, the ejecting amount of which is variable, are alternately arranged, whereby an ink droplet is ejected at a constant interval either in the case where small ink droplets are ejected from all ink flowing paths and in the case where only the second ink flowing path is used for ejecting large ink droplets from the second ink flowing path. Therefore, space between dots formed onto a recording sheet does not vary, so that the dots can be arranged without space.

Accordingly, an image can be formed with a resolution corresponding to pitches of the first and second ink flowing paths in the case of ejecting small ink droplets from the first and second ink flowing paths, while an image can be formed with a resolution corresponding to a pitch of the second ink flowing path in the case of ejecting large ink droplets from the second ink flowing path.

Further, the present invention also provides an ink jet print head on which an amount of the minimum ink droplet ejected from the second ink flowing path becomes the same as an amount of an ink droplet ejected from the first ink flowing path, no variation occurs in the diameters of dots recorded onto a recorded sheet formed by the ink droplet ejected from the first ink flowing path and the minimum ink droplet ejected from the second ink flowing path. Further, an image can be formed with a resolution corresponding to pitches of the first and second ink flowing paths.

In this case, the first ink flowing path has a constant ejecting amount, so that it is sufficient to have a flowing width required for ejecting ink droplets in a smaller amount. Therefore, the flowing width of the first ink flowing path in the fast-scanning direction can be formed narrow compared to the case where the ejecting amount from all of the ink flowing paths is made variable. Accordingly, the flowing width of the second ink flowing path that ejects ink droplets in the same amount as the ink droplets ejected from the first ink flowing path as the minimum size ink droplet can be widened compared to the case where the ejecting amount from all of the ink flowing paths is made variable, thereby being capable of arranging a larger heating element compared to the conventional ink jet recording head having a construction that the ejecting amount from all of the ink flowing paths is made variable.

By this construction, it may be possible to establish the volume ratio of 1:3 or more of the volume of the minimum ink droplet that can be ejected from the ink jet recording head to the volume of the maximum ink droplet that can be ejected from the ink jet recording head. Therefore, the problem does not occur that, when the resolution in the normal printing is increased so as pirorly to obtain an image of high quality, the space between dots formed onto a recording sheet is enlarged in high-speed printing to obtain an image having a lower density than the desired density, and conversely that, when high-speed printing takes priority, the resolution in the normal printing is decreased to degrade image quality. Accordingly, an ink jet recording head can be obtained wherein a satisfactory image can be obtained in high-quality printing as well as an image having satisfactory density can be obtained in high-speed printing.

Moreover, the ink jet recording head may have the construction, disclosed in another aspect of the present invention, that ink is ejected by an electricity/heat converting element that converts electricity into heat. By using the electricity/heat converting element, the amount of ink droplet can be controlled with high precision by a relatively simple construction.

Further, a heating element or the like in which the amount of generating heat increases according to the value of the applied voltage can be used for ejecting ink droplets from the second ink flowing path. This heating element may be made of plural electricity/heat converting elements as disclosed in another aspect of the present invention.

In this case, when the second ink flowing path ejects the minimum size ink droplet, one or predetermined numbers of electricity/heat converting elements may be controlled to be driven, while electricity/heat converting elements more in number than the one or predetermined numbers of electricity/heat converting elements may be controlled to be driven when the second ink flowing path ejects the ink droplets larger than the minimum size ink droplet.

Moreover, the volume of the ejected ink droplet varies according to the amount of generating heat of the driven electricity/heat converting element, so that it is possible to selectively eject ink droplets of volumes of two kinds or more by performing a close control such that the number of the driven electricity/heat converting elements is changed two, three, four.

Further, the ink jet recording head of the present invention may have the construction that the electricity/heat converting element for the minimum size is driven when ejecting the minimum size ink droplet, while the electricity/heat converting element for a large ink droplet is driven when ejecting the large ink droplet.

Moreover, the electricity/heat converting element that is driven when ink droplets of the least amount are ejected from the second ink flowing path, i.e., the one or predetermined numbers of the electricity/heat converting elements, may be arranged at the nearest position from a projecting opening of the second ink flowing path, ink droplets in the same amount as ink droplets ejected from the first ink flowing path can be ejected with high precision from the second ink flowing path having the flowing width larger than that of the first ink flowing path.

Additionally, when a dot having a large diameter is recorded by the ink droplet ejected from the second ink flowing path, a relative moving speed in a slow-scanning direction may be increased according to a ratio of a diameter that is made large compared to a relative moving speed in the slow-scanning direction when a dot having a small diameter is recorded.

Specifically, an area covered by dots formed on the recording sheet by an ejected ink droplet in high-speed printing may be enlarged according to the ratio of the increasing diameter with respect to an area covered by dots formed on a recording sheet by ejected ink droplets in high quality image printing.

Therefore, at least either one of the moving speed in the slow-scanning direction of the ink jet recording head or the feeding speed of the recording sheet may be controlled such that the relative moving speed in the slow-scanning direction of the ink jet recording head in high-speed printing is increased according to the ratio of the diameter that is made large compared to the relative moving speed in the slow-scanning direction of the ink jet recording head in high quality image printing.

By this, dots formed on a recording sheet by the ejected ink droplets may be arranged with a satisfactory space therebetween, not excessively overlaying with each other and not having an excessive space therebetween.

Additionally, when a dot having a large diameter is recorded by the ink droplet ejected from the second ink flowing path, an ejecting frequency is decreased according to a ratio of a diameter that is made large compared to an ejecting frequency when a dot having a small diameter is recorded.

Specifically, an area covered by dots formed on a recording sheet by an ejected ink droplet in high-speed printing is enlarged according to the ratio of the increasing diameter with respect to an area covered by dots formed on a recording sheet by ejected ink droplets in high quality image printing. Therefore, the number of dots formed on the recording sheet decreases for the enlarged area.

Therefore, when a dot having a large diameter is recorded by a plenty of ink droplets ejected from the second ink flowing path, the ejecting frequency is decreased according to the ratio of the diameter that is made large, whereby dots formed on a recording sheet by the ejected ink droplets are arranged with a satisfactory space therebetween, not excessively overlaying with each other and not having an excessive space therebetween.

In this case, the relative moving speed of the ink jet recording head in the slow-scanning direction dose not change. However, dots formed on a recording sheet by the ejected ink droplets are arranged with a satisfactory space therebetween, not excessively overlaying with each other and not having an excessive space therebetween, with the result that there is no disadvantage such as a thin density. Therefore, a sufficient density can be obtained by one ejection. The printing operation completes faster since the compensation processing after that is not required.

When a magnification of a maximum resolution to a minimum resolution by the ink droplet ejected from the second ink flowing path is rendered to be n, first ink flowing paths in the number of n−1 and a single second flowing path may be arranged in the set of the ink flowing paths as described in another aspect of the present invention.

BRIEF DESCRIPTION OF THE DRAWINGS

Preferred embodiments of the present invention will be described in detail based on the followings, wherein.

DESCRIPTION OF THE PREFERRED EMBODIMENTS

An embodiment of the present invention will be explained hereinbelow with reference to FIG. 1 to FIG. 6. The embodiment of the present invention is the one in which an ink jet recording head of the present invention is adapted to a recording head of an ink jet recording apparatus of a thermal ink jet type.

(First Embodiment)

Figure 1:
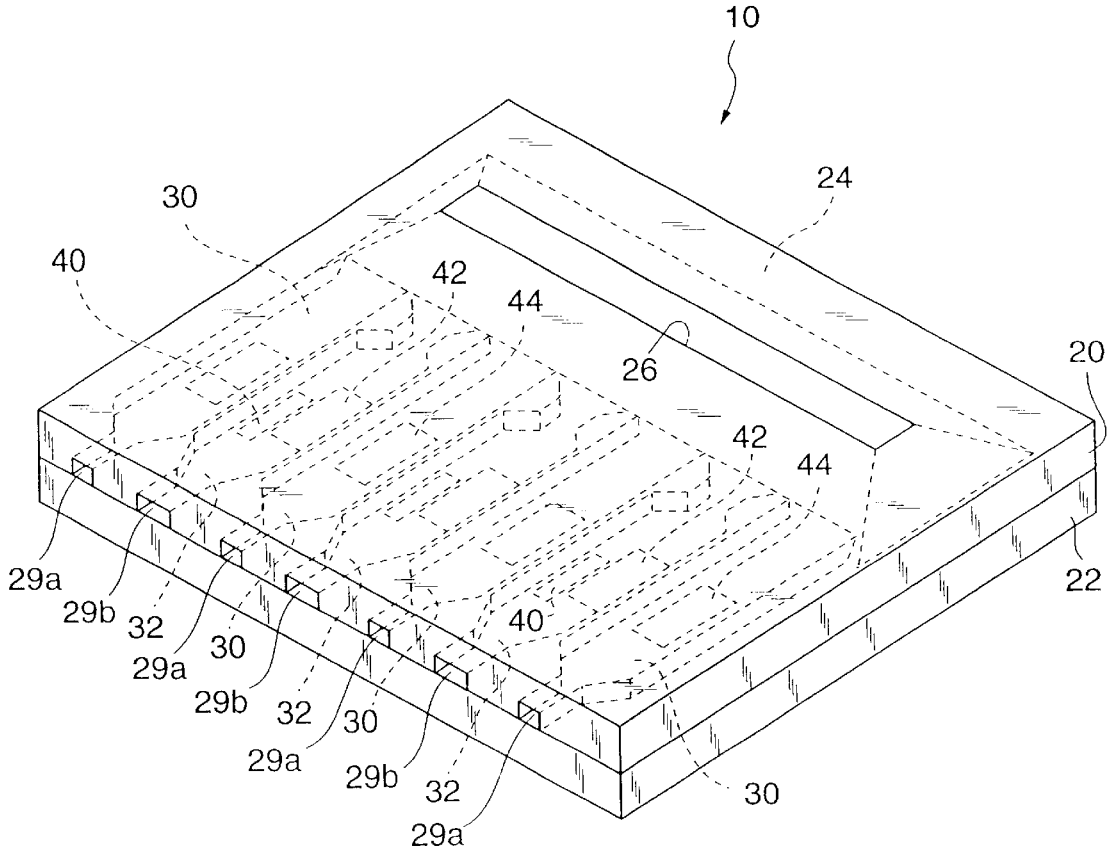
FIG. 1 is a perspective explanatory view showing a schematic construction of an ink jet recording head used in an ink jet recording apparatus of a first embodiment according to the present invention.
Figure 2A:
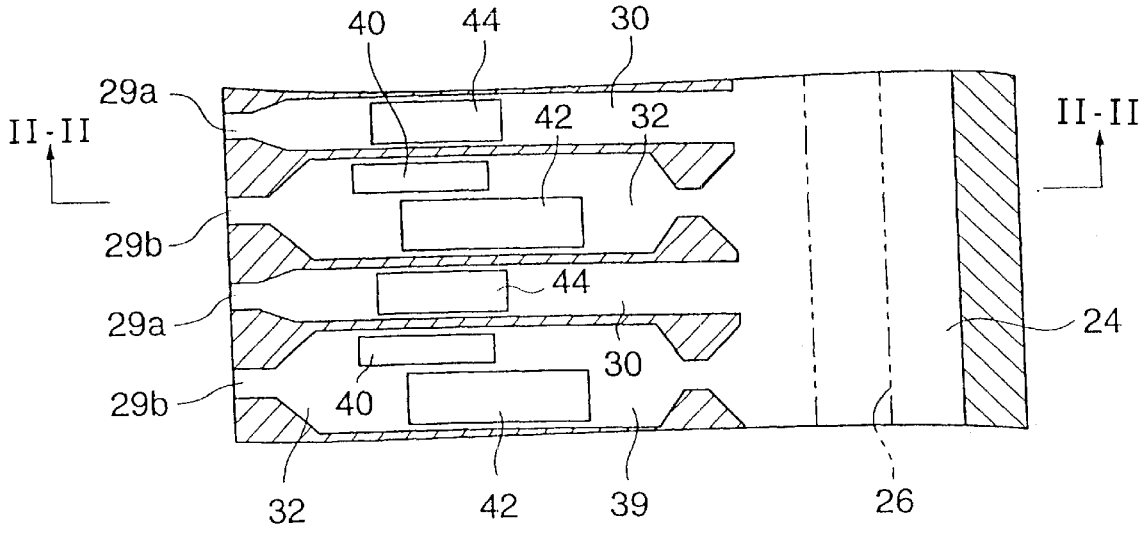
FIG. 2A is a top plan view showing a schematic construction of an ink flowing path of the ink jet recording head shown in FIG. 1.
Figure 2B:
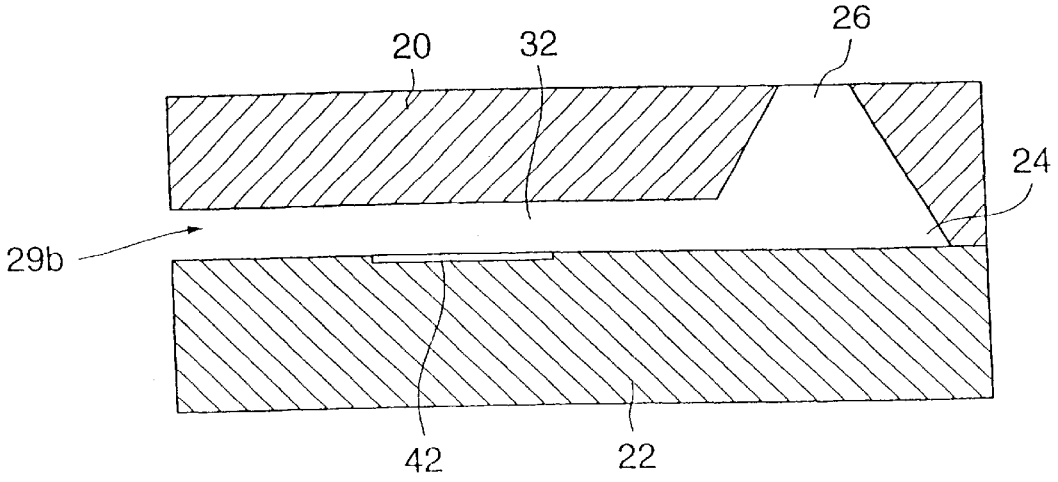
FIG. 2B is a view in section taken along the line II—II in FIG. 2A.
Figure 3:
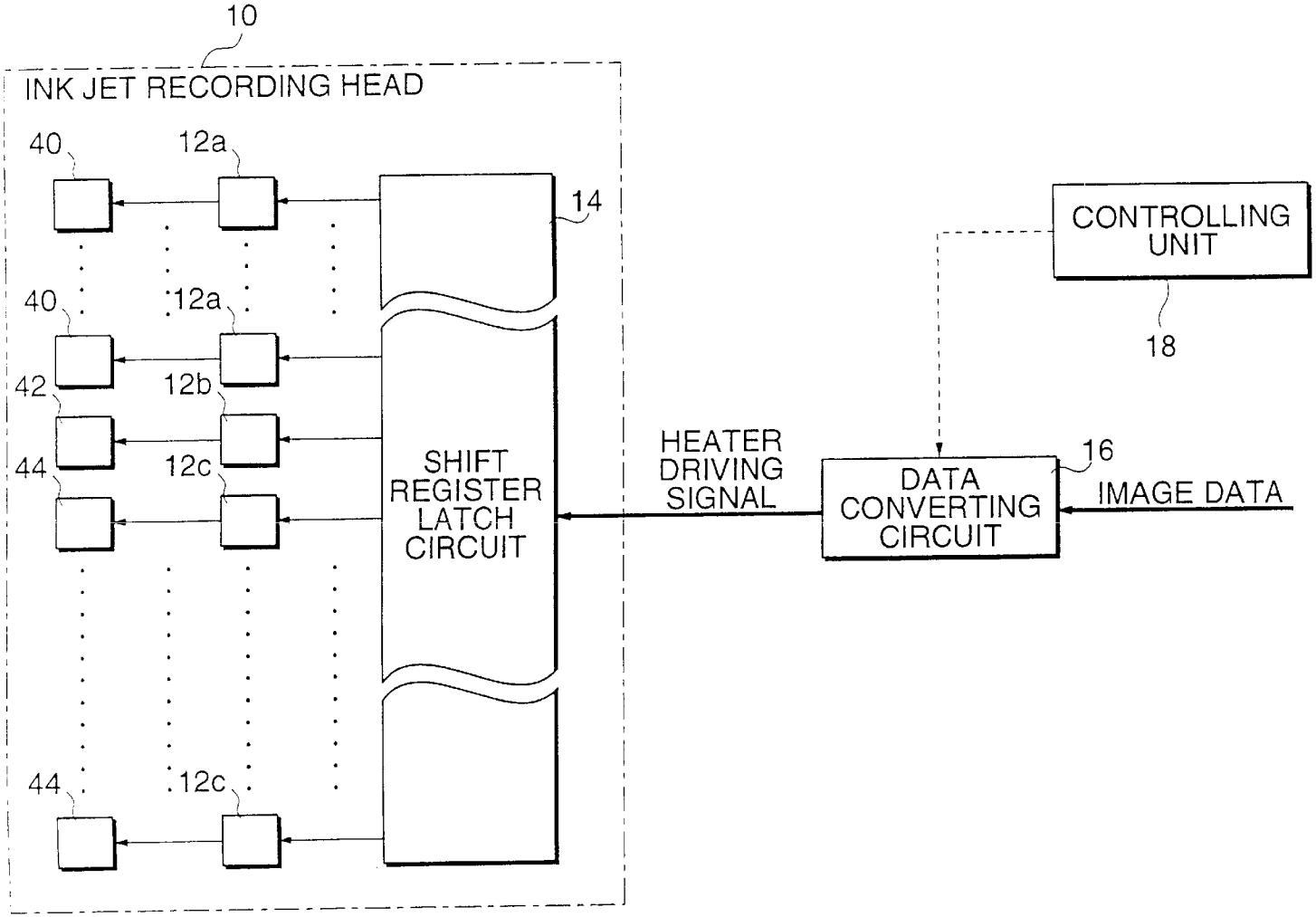
FIG. 3 is a block diagram for explaining a schematic construction of the ink jet recording apparatus of the first embodiment.

An ink jet recording apparatus according to a first embodiment is provided with an ink jet recording head of a thermal ink jet type having a construction shown in FIG. 1 to FIG. 3. This ink jet recording head 10 has a heating substrate 22 and a flowing path substrate 20 mounted on the heating substrate 22.

The flowing path substrate 20 is provided with an ink supplying opening 26 having a rectangular opening from which ink is introduced from an ink tank not shown, an ink chamber 24 that temporarily contains ink introduced from the ink supplying opening 26 and plural ink flowing paths 30, 32 each having one end that is open to the ink chamber 24 as well as each having the other end that is provided with ejecting openings 29*a* and 29*b*.

The plural ink flowing paths are constructed from a first ink flowing path 30 from which ink droplets of 7 pl are ejected, i.e., the ejecting amount of which is constant, and a second ink flowing path 32 selectively ejecting either one of large or small volume ink droplets, i.e., either one of 7 pl ink droplets or 30 pl ink droplets. Specifically, the volume of ejected ink droplets from the second ink flowing path is variable. Sets of ink flowing paths including these two kinds of ink flowing paths 30 and 32 are formed alternately to the flowing path substrate 20.

The ejecting openings 29*a* and 29*b* of these two kinds of ink flowing paths 30 and 32 become an orifice. The opening diameter of the ejecting opening 29*a* of the first ink flowing path 32 is, for example, approximately 9 μm in width and approximately 15 μm in height, while the opening diameter of the ejecting opening 29*b* of the second ink flowing path 32 is, for example, approximately 16 μm in width and approximately 15 μm in height. The space between the opening center of the ejecting opening 29*a* and the opening center of the adjacent ejecting opening 29*b* is constructed to be 31.75 μm. This space corresponds to a resolution of 800 dpi, and the space between the opening center of the ejecting openings is determined according to a recording maximum resolution.

The flowing width of the first ink flowing path 30 is, for example, approximately 19 μm and the maximum flowing width of the second ink flowing path 32 is, for example, approximately 35 μm. The maximum flowing width of the second ink flowing path 32 is formed larger than the pitch of 800 dpi dots (i.e., 31.75 μm), so that the second ink flowing path 32 can assure ink that is sufficient for forming dots of 400 dpi.

The second ink flowing path 32 is provided at the maximum flowing width with a first heater 40 made of an electricity/heat converting element having a size of, for example, approximately 8 μm in length and approximately 65 μm in width, and a second heater 42 made of an electricity/heat converting element having a size of, for example, approximately 20 μm in length and approximately 65 μm in width. These first and second heaters 40 and 42 are arranged laterally to have a space of approximately 3 μm therebetween. The first heater 40 is disposed at a position closer to the ejecting opening 29*a* compared to the second heater 42 for enabling satisfactory ejecting of a small ink droplet.

The second ink flowing path 32 ejects ink droplets of 7 pl from the ejecting opening 29*b* when only the first heater 40 is selectively driven while it ejects ink droplets of 30 pl from the ejecting opening 29*b* when the first heater 40 and the second heater 42 are selectively driven.

The dots formed onto a recording sheet by adhering ink droplets of 7 pl corresponds to 800 dpi dots, i.e., corresponds to ink droplets sufficient for nearly filling a lattice of 31.75 μm in length and 31.75 μm in width, while the dots formed onto a recording sheet by adhering ink droplets of 30 pl corresponds to 400 dpi dots, i.e., corresponds to ink droplets sufficient for nearly filling a lattice of 63.5 μm in length and 63.5 μm in width.

Further, as shown in FIG. 1 and FIG. 3, the first ink flowing path 30 is provided with a third heater 44 made of an electricity/heat converting element having a size of, for example, approximately 10 μm in length and approximately 65 μm in width. This third heater 44 can be driven when only the first heater 40 of the second ink flowing path 32 is selectively driven. When the first heater 40 is driven, the third heater 44 is controlled to cause ink droplets of 7 pl to be ejected from the ejecting opening 29*a* of the first ink flowing path 30. On the other hand, it is controlled not to be driven when the first heater 40 and the second heater 42 of the second ink flowing path 32 are selectively driven.

Formed to the heating substrate 22 that is mounted below the flowing path substrate 20 provided with these ink flowing paths are the first heater 40 and the second hater 42 mounted at the position corresponding to the first ink flowing path 30, and the third heater 44 is mounted at the position corresponding to the second ink flowing path 32.

Each heater 40, 42 and 44 is selectively driven according to a printing mode instructed from a controlling section (to be described later) of the ink jet recording apparatus. Further, provided at the heating substrate 22 are devices and wiring (not shown) such as heater drivers 12*a*, 12*b* and 12*c* (refer to FIG. 3) that apply an electric pulse to the heater of a position according to an image signal.

Subsequently, a control of the ink jet recording head by the ink jet recording apparatus will be explained with reference to FIG. 3 and FIG. 4. The ink jet recording head has a set of one first ink flowing path 30 provided with the third heater 44 and one second ink flowing path 32 provided with the first heater 40 and the second heater 42, this set being alternately arranged.

As shown in FIG. 3, the ink jet recording apparatus of the present embodiment is provided with a data converting circuit 16 for converting a dot position of the inputted image data into a heater driving signal corresponding to each ink flowing path 30 and 32 of the ink jet recording head 10, a controlling unit 18 for switching over two modes of a converting mode for normal printing and a converting mode for high-speed printing from the data converting mode by the data converting circuit 16 based upon a printing mode (that is, two kinds of normal printing mode and high-speed printing mode) selected by an operator, and the ink jet recording head 10.

Provided at the ink jet recording head 10 are three kinds of heaters, i.e., the first heater 40, the second heater 42 and the third heater 44, heater drivers 12*a*, 12*b* and 12*c* each mounted corresponding to each heater, and a shift register latch circuit 14 for driving the heater driver of each position based upon a heater driving signal inputted from the data converting circuit 16.

An image signal inputted from outside to the ink jet recording apparatus having such a construction is converted into the heater driving signal by the data converting circuit 16 based upon the converting mode by an instruction from the controlling unit 18. This heater driving signal is the one that is generated corresponding to each heater for ON/OFF control of each of one or two heaters provided every ink flowing path.

Specifically, when the normal printing mode is instructed from the controlling unit 18, the image data is converted so as to apply an electric pulse to the first heater 40 and the third heater 44. At this time, data given to the first heater 40 and the third heater 44 corresponds to each individual dot of 800 dpi. The controlling unit 18 sets a transporting speed (a speed in a slow-scanning direction) of a recording sheet by a transporting unit (not shown) to a normal speed.

Further, when the high-speed printing mode is instructed from the controlling unit 18, the image data is converted so as to apply an electric pulse to the first heater 40 and the second heater 42. At this time, data given to the first heater 40 and the second heater 42 corresponds to each individual dot of 400 dpi. Since ink droplets having a size corresponding to 400 dpi are ejected from the second ink flowing path 32, the controlling unit 18 sets a transporting speed of a recording sheet by a transporting part (not shown) to a speed double of a normal speed.

The heater driving signal converted by the data converting circuit 16 as described above is outputted to each heater driver 12*a,* 12*b* and 12*c* positioned at the corresponding position. The heater drivers 12*a,* 12*b* and 12*c* apply an electric pulse to the heaters 40, 42 and 44 according to the inputted signal.

Figure 4A:
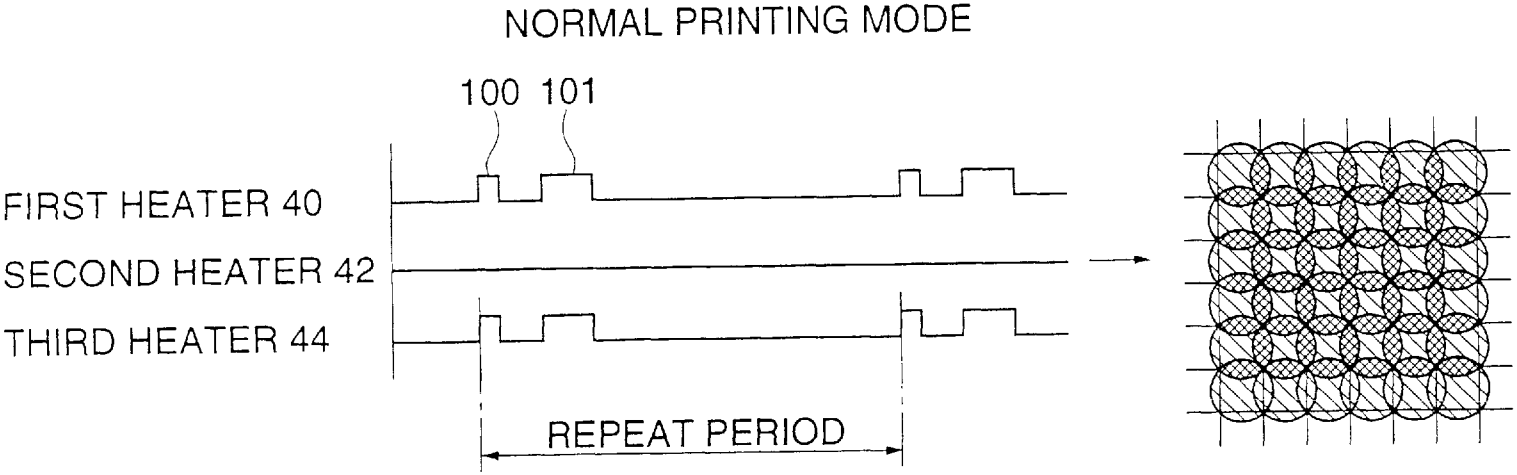
FIG. 4A is a view showing a driving electric pulse of three heaters and positions of dots formed on a recording sheet in a normal printing mode.
Figure 4B:
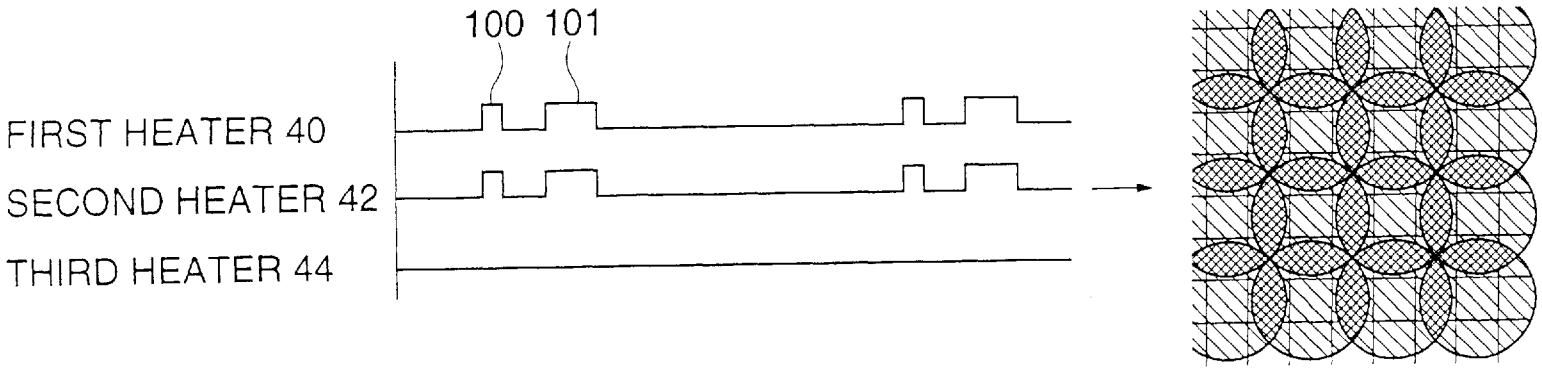
FIG. 4B is a view showing a driving electric pulse of three heaters and positions of dots formed on a recording sheet in a high-speed printing mode.

Specifically, when the normal printing mode is instructed from the controlling unit 18, the electric pulse is applied to the first heater 40 and the third heater 44 as shown in FIG. 4A, while the electric pulse is applied to the first heater 40 and the second heater 42 when the high-speed printing mode is instructed from the controlling unit 18 as shown in FIG. 4B.

In FIGS. 4A and 4B, a control is made such that a pulse 100 (referred to as pre-pulse hereinbelow) that does not generate a bubble on the heater is applied for warming the heater (i.e., electricity/heat converting element), and then, a main pulse 101 is applied thereto to generate a bubble for ejecting ink droplets. The pre-pulse 100 and main pulse 101 are repeated in a constant period, whereby ink droplets are ejected in a constant timing.

It can be adjusted to always eject ink droplets of a constant volume, not depending on an environmental temperature or a temperature of the ink jet recording head, by varying a width or number of the pre-pulse 100.

The flowing path substrate 20 having formed thereon the ink flowing paths 30 and 32 and ink ejecting openings 29*a* and 29*b* having such constructions as well as the ink chamber 24 to which one end of the ink flowing path is open can be manufactured by a method disclosed, for example, in Japanese Published Unexamined Patent Application No. Hei 9-341658. One example of the manufacturing method will be briefly explained hereinbelow.

One side of a substrate made of a silicon is rendered to be a patterning surface. Firstly, a first etching-resistant mask layer made of, for example, $SiO_2$ film is overlaid onto the both surfaces of the substrate. Then, the patterning surface is patterned such that the ink chamber and the ink flowing path connecting with the ink chamber are exposed.

Subsequently, a second etching-resistant mask layer made of, for example, SiN film is overlaid onto the both surfaces of the substrate. Then, the second etching-resistant mask layer on the patterning surface is patterned such that the second etching-resistant mask layer on the ink flowing area and the ink chamber area is removed by using a photolithography technique and a dry-etching method.

The ink chamber 24 and the rectangular opening that becomes the ink supplying opening 26 are formed by a wet anisotropic etching using, for example, an etching solution such as KOH solution with the second etching-resistant mask layer pattern as a mask.

Thereafter, the second etching-resistant mask layer pattern is selectively removed.

Further, the ink chamber and the ink flowing path section connecting with the ink chamber are etched by RIE (reactive ion etching) with the first etching-resistant mask layer pattern as a mask.

Then, the first etching-resistant mask layer pattern is removed to obtain the flowing path substrate 20 provided with the ink flowing paths 30 and 32, ink ejecting openings 29*a* and 29*b* and the ink chamber 24 to which ends on one side of all the ink flowing paths are open.

As described above, the ink jet recording head of the first embodiment can record with high image quality with 800 dpi resolution as well as can perform high-speed printing without thinning a density with 400 dpi resolution.

(Second Embodiment)

A second embodiment of the present invention will be explained hereinbelow with reference to FIG. 5 and FIG. 6. The second embodiment is an application of the first embodiment. Accordingly, the construction and manufacturing method except for the ink flowing path are the same as those of the first embodiment, thereby omitting a detailed explanation.

Figure 5:
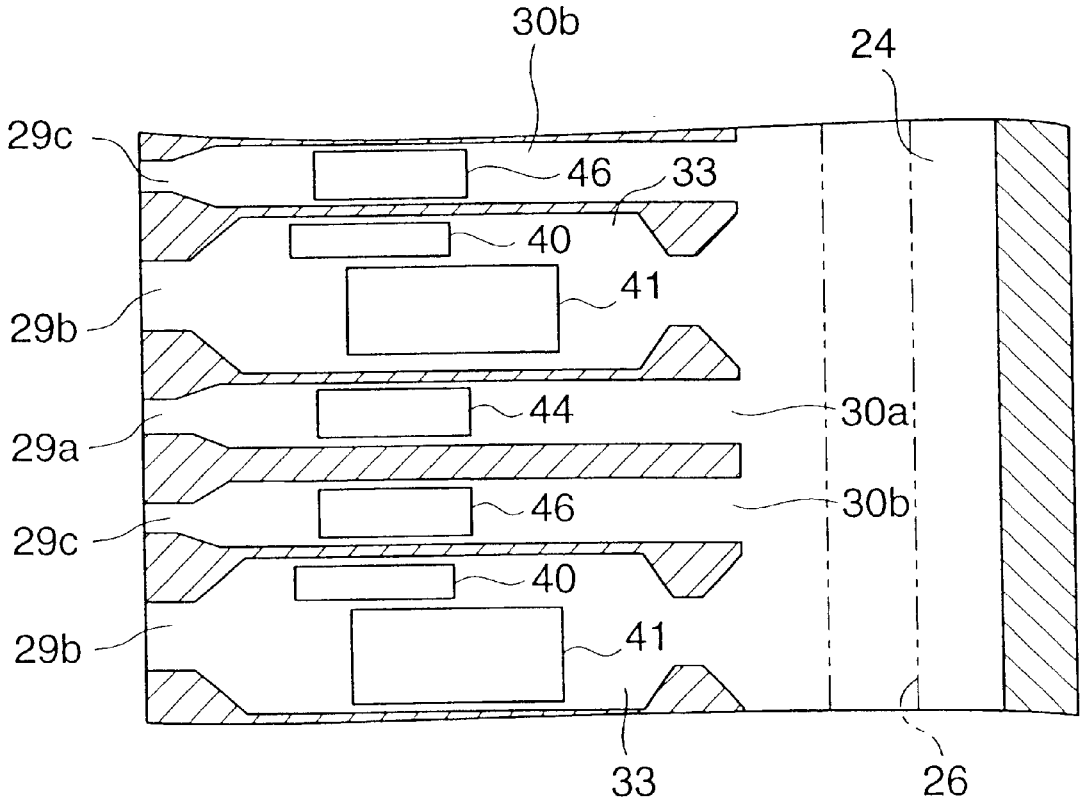
FIG. 5 is a top plan view showing a construction of an ink flowing path of an ink jet recording apparatus of a second embodiment according to the present invention.

As shown in FIG. 5, the ink jet recording head of the second embodiment has a set of ink flowing paths including two first ink flowing paths 30*a* and 30*b* from which ink droplets of 7 pl are ejected, i.e., the ejecting amount of which is constant, and a third ink flowing path 33 selectively ejecting either one of large or small volume ink droplets, i.e., either one of 7 pl ink droplets or 45 pl ink droplets. Specifically, the volume of the ejected ink droplets from the third ink flowing path 33 is variable. Sets of ink flowing paths including these three kinds of ink flowing paths are formed alternately to the flowing path substrate 20.

Two first ink flowing paths 30*a* and 30*b* has the same construction as the first ink flowing path 30 of the first embodiment, and the third ink flowing path 33 has almost the same construction as the second ink flowing path 32 of the first embodiment. In the second embodiment, the size of the third ink flowing path 33 is the flowing width that can eject ink droplets of 45 pl. Provided in the third ink flowing path 33 are the first heater 40 for ejecting ink droplets of 7 pl and a fourth heater 41 that is driven with the first heater 40 for ejecting ink droplets of 45 pl. The first heater 40 is disposed at a position closer to the ejecting opening 29*a* compared to the fourth heater 41 for enabling a satisfactory ejection of a small ink droplet.

Further, in the second embodiment, the maximum flowing width of the third ink flowing path 33 is formed larger than the pitch of 800 dpi dots (i.e., 31.75 $\mu$m), so that the third ink flowing path 33 can assure ink that is sufficient for forming dots of 267 dpi.

The dots formed onto a recording sheet by adhering ink droplets of 7 pl corresponds to 800 dpi dots, i.e., corresponds to ink droplets sufficient for nearly filling a lattice of 31.75 $\mu$m in length and 31.75 $\mu$m in width, while the dots formed onto a recording sheet by adhering ink droplets of 45 pl corresponds to 267 dpi dots that is a third of 800 dpi, i.e., corresponds to ink droplets sufficient for nearly filling a lattice of 95.25 $\mu$m in length and 95.25 $\mu$m in width.

A control of the ink jet recording head of the ink jet recording apparatus having such an ink jet recording head will be explained with reference to FIG. 6. The ink jet recording head has a set of the first ink flowing path 30*a* provided with the third heater 44, the first ink flowing path

30*b* provided with a fifth heater and the single second ink flowing path 32 provided with the first heater 40 and the fourth heater 41, plural sets being alternately arranged. However, the controls of only the first heater 40, third heater 44, fourth heater 41 and a fifth heater 46 are explained in FIG. 6 for brief explanation. Moreover, the other constructions of the ink jet recording apparatus are the same as those in the first embodiment, so that the detailed explanation is omitted.

Figure 6A:
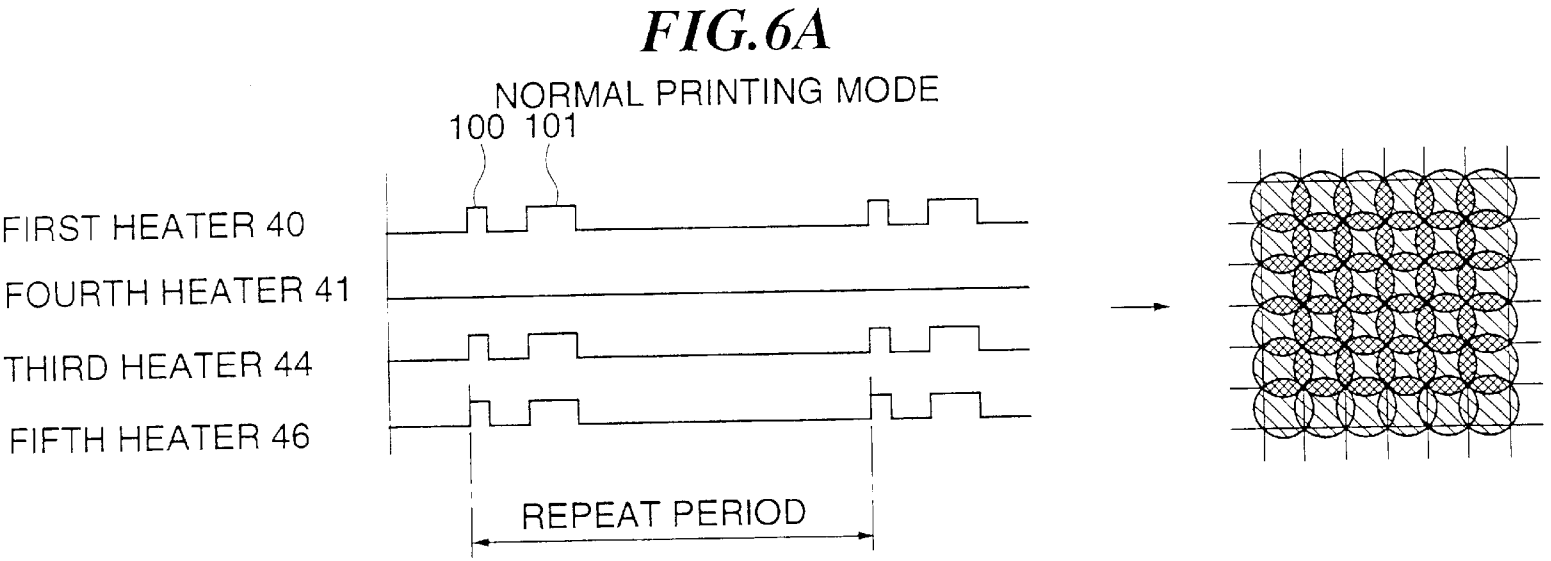
FIG. 6A is a view showing a driving electric pulse of four heaters and positions of dots formed on a recording sheet in a normal printing mode.

When the normal printing mode is instructed from the controlling unit 18, the electric pulse is applied to the first heater 40, the third heater 44 and the fifth heater 46 as shown in FIG. 6A, whereby ink droplets of 7 pl are ejected from all of the ink flowing paths to be printed with a resolution of 800 dpi.

Figure 6B:
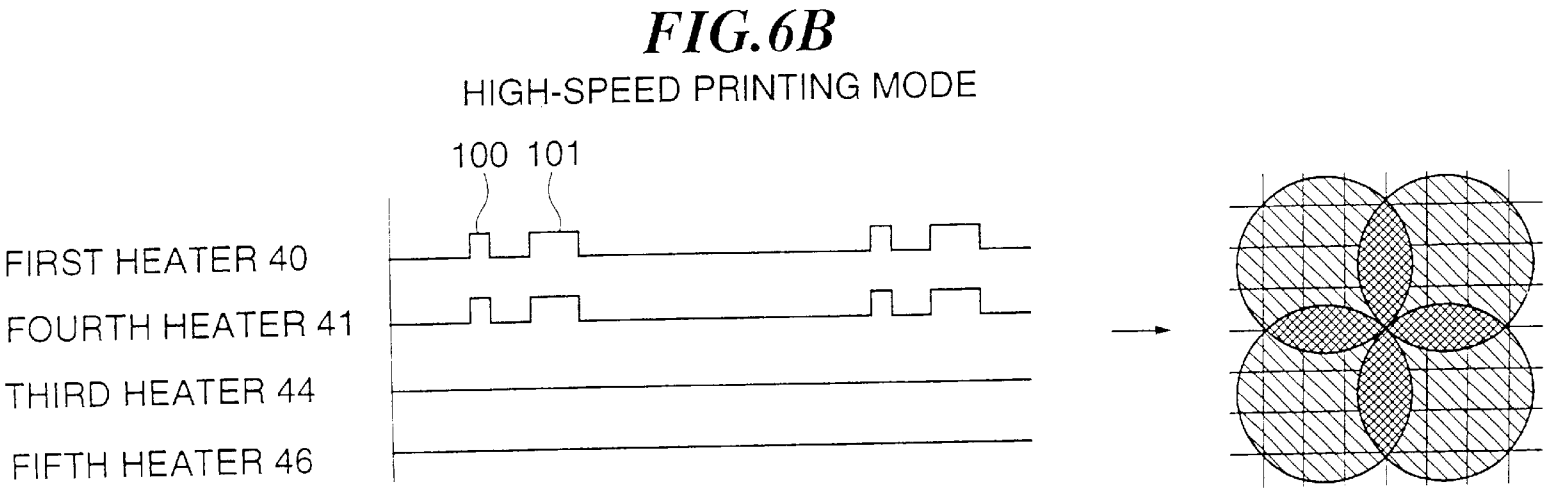
FIG. 6B is a view showing a driving electric pulse of four heaters and positions of dots formed on a recording sheet in a high-speed printing mode.
Figure 7:
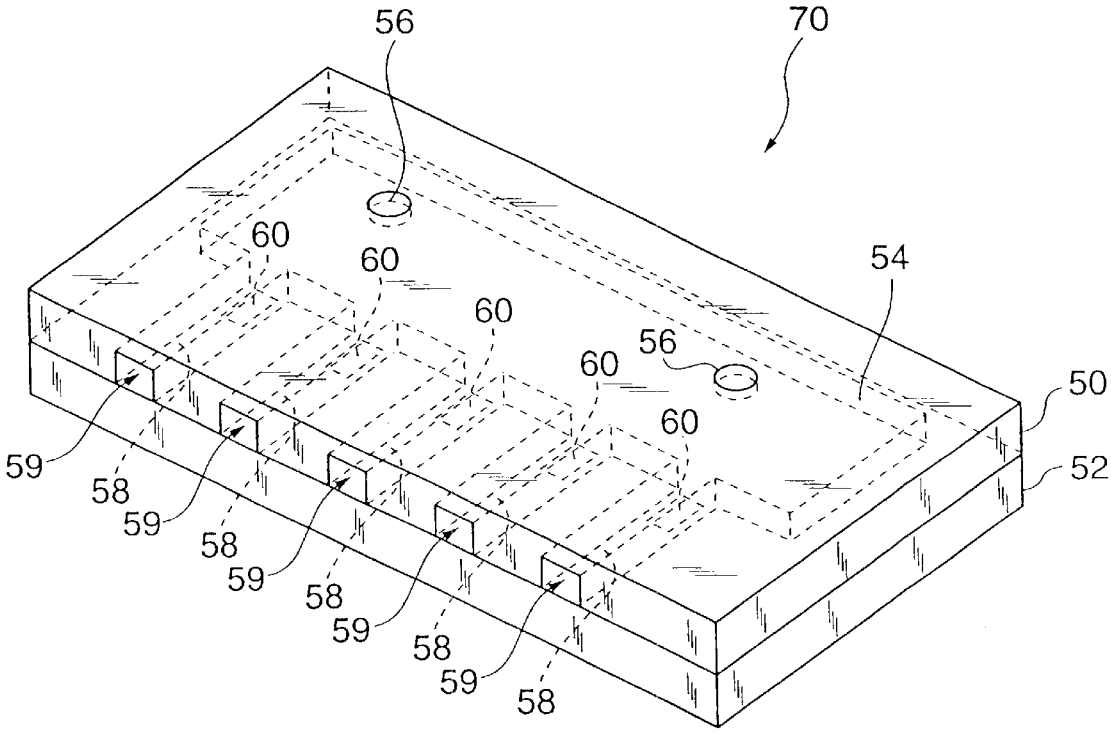
FIG. 7 is a perspective explanatory view showing a schematic construction of a conventional ink jet recording head.
Figure 8A:
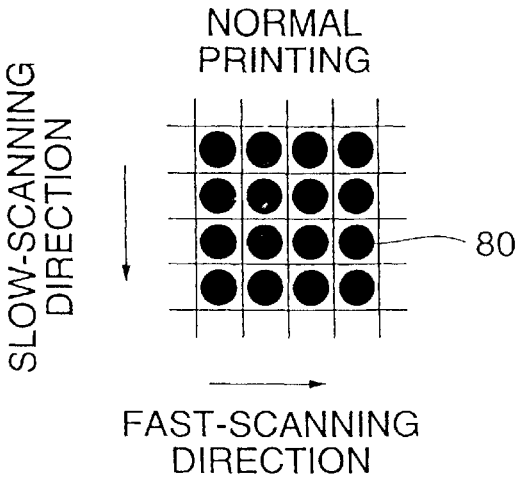
FIGS. 8A and 8B are views showing positions of dots formed onto a recording sheet in normal printing and positions of dots formed onto a recording sheet in thinning-out printing.
Figure 8B:
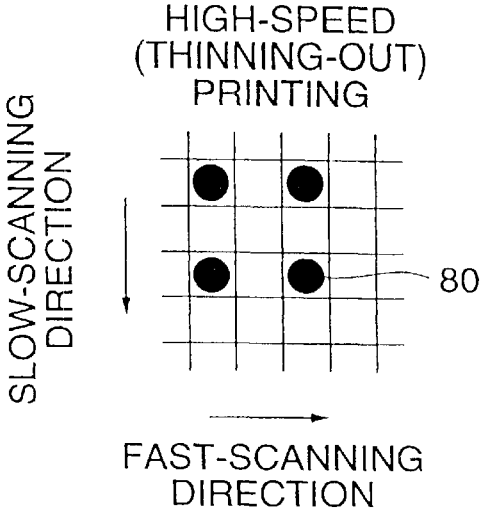
RELATED ART FIG.8B
Figure 9A:
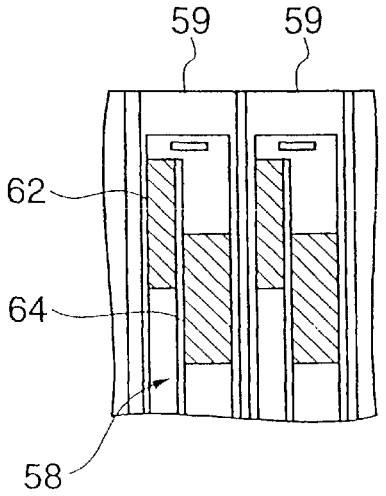
RELATED ART FIG.9A
FIGS. 9A and 9B are top plan views showing a schematic construction of an ink flowing path of a conventional ink jet recording head in which plural heaters are provided in a single flowing path.
Figure 9B:
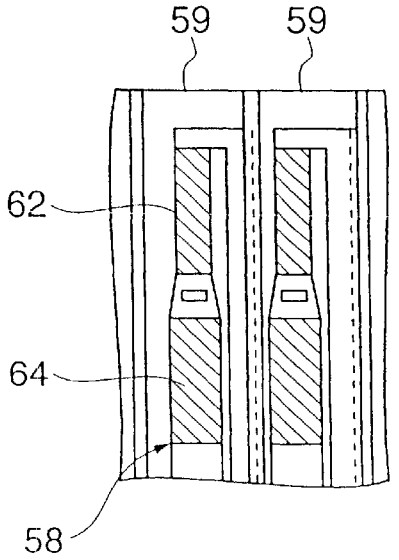
RELATED ART FIG.9B

When the high-speed printing mode is instructed from the controlling unit 18, the electric pulse is applied to the first heater 40 and the fourth heater 41 as shown in FIG. 6B, whereby ink droplets of 45 pl are ejected only from the third ink flowing path 33 to be printed with a resolution of 267 dpi.

As described above, the ink jet recording head of the second embodiment can realize a volume ratio of ink droplet of 1:6.4, whereby the ratio of the dot diameter formed on the recording sheet can be rendered to be approximately 1:3.

Accordingly, printing can be performed with a resolution of approximately 800 dpi in the normal printing mode, as well as the printing speed in the high-speed printing can be tripled compared to the printing speed in normal printing without thinning the printed matter in high-speed printing.

Specifically, in order to realize a magnification of n of the maximum resolution to the minimum resolution, the first ink flowing path in the number of n−1 and a single second ink flowing path may be provided in the set of the ink flowing paths.

The volume of ink droplet and numerical values such as a size of a dot explained in the first and second embodiments are not limited thereto in the present invention, and can suitable be changed in accordance with a desired resolution.

The case where the resolution is changed in two levels in the above embodiments. However, the resolution can be changed in three levels by causing the first ink flowing path to eject ink droplets of volume V1 and causing the second ink flowing path to eject ink droplets of volume V1 and volume V2 and further by providing a third ink flowing path that can eject ink droplets of volume V1, volume V2 and volume V3.

As explained above, according to the present invention, an ink jet recording head can be obtained in which an ink droplet having a small volume that can realize a desired image quality can be ejected onto a recording sheet without making a space between dots in normal printing, and further, in which an ink droplet having a large volume that can afford a sufficient density can be ejected even when thinning-out printing is performed in high-speed printing.

What is claimed is:

1. An ink jet recording head comprising:

a first ink flowing path having a first thermal element that ejects ink supplied from one side thereof from an ejecting opening at the other side thereof as an ink droplet of a constant amount; and a second ink flowing path larger than the first ink flowing path and having a second thermal element and a third thermal element and that can eject ink supplied from one side thereof from an ejecting opening at the other side thereof as an ink droplet of an amount more than the constant amount as well as that can adjust the amount of the ink droplet to be ejected, wherein sets of ink flowing paths comprising the first ink flowing path and the second ink flowing path are alternately arranged, and wherein selective activation of the second thermal element and third thermal element adjusts the amount of an ink droplet from substantially the constant amount to an amount more than the constant amount.

2. An ink jet recording head claimed in claim 1, wherein an amount of the minimum ink droplet ejected from the second ink flowing path becomes the same as an amount of an ink droplet ejected from the first ink flowing path.

3. An ink jet recording head claimed in claim 1, wherein ink is ejected by one of the thermal elements that converts electricity into heat.

4. An ink jet recording head claimed in claim 1, wherein the first thermal element is deactivated when the second thermal element and the third thermal element are activated.

5. An ink jet recording head claimed in claim 1, wherein the thermal element that is driven when an ink droplet of the constant amount is ejected from the second ink flowing path is arranged at the nearest position from a projecting opening of the second ink flowing path.

6. An ink jet recording head claimed in claim 1, wherein, when a dot having a large diameter is recorded by the ink droplet ejected from the second ink flowing path, a relative moving speed in a slow-scanning direction is increased according to a ratio of a diameter that is made large compared to a relative moving speed in the slow-scanning direction when a dot having a small, diameter is recorded.

7. An ink jet recording head claimed in claim 1, wherein, when a dot having a large diameter is recorded by the ink droplet ejected from the second ink flowing path, an ejecting frequency is decreased according to a ratio of a diameter that is made large compared to an ejecting frequency when a dot having a small diameter is recorded.

8. An ink jet recording head claimed in claim 1, wherein, when a magnification of a maximum resolution to a minimum resolution by the ink droplet ejected from the second ink flowing path is rendered to be n, first ink flowing paths in the number of n−1 and a single second flowing path are arranged in the set of the ink flowing paths.

9. An ink jet recording head comprising:

a first ink flowing path having a relatively large inner volume containing a plurality of thermal elements therein; and a second ink flowing path having a relatively small amount of inner volume containing a single thermal element therein; wherein the first ink flowing path and the second ink flowing path are multiply arranged as at least a pair thereof, and wherein the single thermal element is deactivated when the plurality of thermal elements are activated.

10. An ink jet printing system including the ink jet recording head as claimed in claim 9.

* * * * *